US007716901B2

(12) United States Patent
Price

(10) Patent No.: US 7,716,901 B2
(45) Date of Patent: May 18, 2010

(54) PACKAGING FOR PARTICULATE AND GRANULAR MATERIALS

(76) Inventor: Charles E. Price, 3514 Hedgewick Pl., Louisville, KY (US) 40245

( * ) Notice: Subject to any disclaimer, the term of this patent is extended or adjusted under 35 U.S.C. 154(b) by 1170 days.

(21) Appl. No.: 11/113,811

(22) Filed: Apr. 25, 2005

(65) Prior Publication Data

US 2005/0276521 A1 Dec. 15, 2005

Related U.S. Application Data

(60) Provisional application No. 60/672,704, filed on Apr. 19, 2005, provisional application No. 60/574,860, filed on May 27, 2004.

(51) Int. Cl.
*B65B 61/14* (2006.01)

(52) U.S. Cl. ..... 53/413; 53/403; 53/469; 53/567; 383/10

(58) Field of Classification Search ..... 53/403, 53/413, 451, 452, 467–469, 476, 551–555, 53/567; 383/10, 16, 62, 78, 81, 207, 209
See application file for complete search history.

(56) References Cited

U.S. PATENT DOCUMENTS

| | | | | |
|---|---|---|---|---|
| 43,567 | A | 7/1864 | Campbell | |
| 1,897,910 | A | 2/1933 | Malvern et al. | |
| 2,093,974 | A | 9/1937 | Farmer | |
| 2,125,318 | A | 8/1938 | Salfisberg | |
| 2,145,941 | A * | 2/1939 | Maxfield | 53/433 |
| 2,305,428 | A | 12/1942 | Johnson | |
| 2,349,369 | A | 5/1944 | Norseen | |
| 2,499,528 | A | 3/1950 | Reitzes | |
| 2,541,674 | A | 2/1951 | Snyder | |
| 2,591,935 | A * | 4/1952 | Heigl | 156/386 |
| 2,622,986 | A | 12/1952 | Snyder et al. | |
| D173,328 | S | 10/1954 | Stoll | |
| 2,779,462 | A | 1/1957 | Hoag | |
| 2,861,406 | A * | 11/1958 | Holsman et al. | 53/459 |
| 2,881,078 | A | 4/1959 | Oritt | |

(Continued)

FOREIGN PATENT DOCUMENTS

| | | |
|---|---|---|
| DE | 76 19 583 | 10/1976 |

(Continued)

OTHER PUBLICATIONS

International Search Report, PCT/US2005/018620, mailed Sep. 23, 2005.

(Continued)

*Primary Examiner*—Thanh K Truong
(74) *Attorney, Agent, or Firm*—Henry B. Ward, III; Moore & Van Allen, PLLC

(57) ABSTRACT

The present invention provides a packaged cementitious product including a bag formed of a polymeric material. The bag has first and second sealed ends. The first end has a first tab extending therefrom defining at least one aperture therethrough so that the first tab defines a first handle. The second end has a second tab extending therefrom defining at least one aperture therethrough so that the second tab defines a second handle. A cementitious product is sealed within the bag, and wherein the first and second handles facilitate the handling of the packaged cementitious product.

17 Claims, 14 Drawing Sheets

U.S. PATENT DOCUMENTS

| | | | | | |
|---|---|---|---|---|---|
| 2,917,223 | A | * | 12/1959 | Le Bolt et al. | 383/32 |
| 2,923,404 | A | | 2/1960 | Adell | |
| 3,146,912 | A | | 9/1964 | Twersky | |
| 3,224,640 | A | | 12/1965 | Schneider et al. | |
| 3,339,825 | A | * | 9/1967 | Grevich | 383/9 |
| 3,383,017 | A | | 5/1968 | Krings | |
| 3,387,701 | A | | 6/1968 | Schneider et al. | |
| D213,479 | S | | 3/1969 | Williams | |
| 3,480,198 | A | | 11/1969 | Repko | |
| 3,492,775 | A | * | 2/1970 | Grevich et al. | 53/451 |
| 3,732,661 | A | | 5/1973 | Goldberger et al. | |
| 3,760,558 | A | * | 9/1973 | Kaminsky et al. | 53/567 |
| 3,811,543 | A | | 5/1974 | Parrochia | |
| 3,812,644 | A | * | 5/1974 | Kamikawa et al. | 53/459 |
| 3,824,760 | A | * | 7/1974 | Sinichenko et al. | 53/459 |
| D235,739 | S | | 7/1975 | Christensen | |
| 3,948,019 | A | * | 4/1976 | Doring et al. | 53/505 |
| 3,961,973 | A | | 6/1976 | Jones | |
| 3,962,080 | A | | 6/1976 | Dulin et al. | |
| 3,982,574 | A | * | 9/1976 | Bianchi et al. | 383/90 |
| 3,999,656 | A | | 12/1976 | Hydorn | |
| 4,040,852 | A | | 8/1977 | Jones | |
| 4,050,258 | A | | 9/1977 | Brewer et al. | |
| 4,050,261 | A | | 9/1977 | Brewer et al. | |
| 4,050,950 | A | | 9/1977 | Brewer et al. | |
| 4,062,195 | A | | 12/1977 | Brewer et al. | |
| 4,081,285 | A | | 3/1978 | Pennell | |
| 4,085,851 | A | * | 4/1978 | Young | 206/554 |
| 4,086,742 | A | * | 5/1978 | Achelpohl et al. | 53/452 |
| 4,094,125 | A | * | 6/1978 | Gess | 53/452 |
| 4,143,202 | A | | 3/1979 | Tseng et al. | |
| 4,212,682 | A | | 7/1980 | Burkett | |
| 4,250,134 | A | | 2/1981 | Minnick | |
| 4,313,762 | A | | 2/1982 | Pound | |
| 4,343,053 | A | | 8/1982 | O'Connor | |
| 4,344,796 | A | | 8/1982 | Minnick | |
| 4,365,710 | A | * | 12/1982 | Swanson | 206/386 |
| 4,373,958 | A | | 2/1983 | Jones et al. | |
| 4,397,801 | A | | 8/1983 | Minnick | |
| 4,403,006 | A | | 9/1983 | Bruce et al. | |
| 4,461,601 | A | | 7/1984 | Pound | |
| 4,472,198 | A | | 9/1984 | Nowicki et al. | |
| 4,510,736 | A | * | 4/1985 | Muller | 53/567 |
| 4,557,385 | A | | 12/1985 | Robinson | |
| 4,566,252 | A | * | 1/1986 | Watanabe et al. | 53/410 |
| 4,613,374 | A | | 9/1986 | Smith | |
| 4,617,045 | A | | 10/1986 | Bronshtein | |
| 4,624,711 | A | | 11/1986 | Styron | |
| 4,720,295 | A | | 1/1988 | Bronshtein | |
| 4,731,120 | A | | 3/1988 | Tuutti | |
| 4,741,782 | A | | 5/1988 | Styron | |
| 4,759,632 | A | | 7/1988 | Horiuchi et al. | |
| 4,772,330 | A | | 9/1988 | Kobayashi et al. | |
| 4,779,996 | A | | 10/1988 | Sengewald | |
| 4,780,144 | A | | 10/1988 | Loggers | |
| 4,804,147 | A | | 2/1989 | Hooper | |
| 4,844,015 | A | | 7/1989 | Garvey et al. | |
| 4,852,504 | A | | 8/1989 | Barresi et al. | |
| 4,872,993 | A | | 10/1989 | Harrison | |
| 4,911,562 | A | | 3/1990 | Mazzeschi | |
| 4,913,293 | A | | 4/1990 | Sanders | |
| 4,913,765 | A | * | 4/1990 | Tetenborg et al. | 156/498 |
| 4,915,741 | A | | 4/1990 | Biagini et al. | |
| 4,917,023 | A | | 4/1990 | Jones | |
| 4,917,733 | A | | 4/1990 | Hansen | |
| 4,988,213 | A | | 1/1991 | Mattle | |
| 4,992,102 | A | | 2/1991 | Barbour | |
| 4,996,943 | A | | 3/1991 | Garvey | |
| 5,019,310 | A | | 5/1991 | Kobayashi | |
| 5,036,978 | A | | 8/1991 | Frank et al. | |
| 5,037,286 | A | | 8/1991 | Roberts | |
| 5,040,920 | A | | 8/1991 | Forrester | |
| 5,044,286 | A | | 9/1991 | Breen et al. | |
| 5,051,031 | A | | 9/1991 | Schumacher et al. | |
| 5,061,318 | A | | 10/1991 | Casey et al. | |
| 5,100,473 | A | | 3/1992 | Mitsuda et al. | |
| 5,106,422 | A | | 4/1992 | Bennett et al. | |
| D327,217 | S | | 6/1992 | Wallace | |
| 5,121,995 | A | | 6/1992 | Newman et al. | |
| 5,127,065 | A | | 6/1992 | Wade | |
| 5,137,753 | A | | 8/1992 | Bland et al. | |
| 5,143,481 | A | | 9/1992 | Schumacher et al. | |
| 5,164,008 | A | | 11/1992 | Casey et al. | |
| 5,170,609 | A | * | 12/1992 | Bullock et al. | 53/434 |
| 5,180,421 | A | | 1/1993 | Rostoker et al. | |
| 5,183,710 | A | | 2/1993 | Gerbino | |
| 5,196,620 | A | | 3/1993 | Gustin et al. | |
| 5,199,377 | A | | 4/1993 | Gehrmann, III et al. | |
| 5,207,164 | A | | 5/1993 | Breen et al. | |
| 5,207,830 | A | | 5/1993 | Cowan et al. | |
| 5,219,229 | A | | 6/1993 | Sengewald | |
| 5,248,040 | A | | 9/1993 | DeMatteis et al. | |
| 5,255,615 | A | | 10/1993 | Magaldi | |
| 5,268,028 | A | | 12/1993 | Fifield | |
| 5,268,131 | A | | 12/1993 | Harrison | |
| 5,282,430 | A | | 2/1994 | Nehls, Jr. | |
| 5,286,430 | A | | 2/1994 | Downs et al. | |
| 5,290,104 | A | | 3/1994 | Sengewald | |
| 5,299,692 | A | | 4/1994 | Nelson et al. | |
| 5,320,051 | A | | 6/1994 | Nehls, Jr. | |
| 5,340,235 | A | | 8/1994 | Milliken | |
| 5,358,760 | A | | 10/1994 | Furlong et al. | |
| 5,362,319 | A | | 11/1994 | Johnson | |
| 5,393,293 | A | | 2/1995 | Cilia et al. | |
| 5,408,807 | A | * | 4/1995 | Lane et al. | 53/551 |
| 5,466,407 | A | | 11/1995 | Downs et al. | |
| 5,472,499 | A | | 12/1995 | Crocker | |
| D365,981 | S | | 1/1996 | Sullivan | |
| 5,482,376 | A | | 1/1996 | Moseley et al. | |
| 5,520,730 | A | | 5/1996 | Barbour | |
| 5,534,058 | A | | 7/1996 | Strabala | |
| 5,545,805 | A | | 8/1996 | Chesner | |
| 5,551,806 | A | | 9/1996 | Milliken | |
| 5,558,438 | A | | 9/1996 | Warr | |
| 5,584,599 | A | | 12/1996 | Knittel | |
| 5,593,229 | A | | 1/1997 | Warr | |
| 5,601,369 | A | | 2/1997 | Moseley et al. | |
| 5,611,626 | A | | 3/1997 | Warr | |
| 5,615,523 | A | | 4/1997 | Wells et al. | |
| 5,616,160 | A | | 4/1997 | Alexander et al. | |
| 5,624,491 | A | | 4/1997 | Liskowitz et al. | |
| 5,636,925 | A | | 6/1997 | Smiley | |
| 5,645,518 | A | | 7/1997 | Wagh et al. | |
| 5,678,234 | A | | 10/1997 | Colombo et al. | |
| 5,681,384 | A | | 10/1997 | Liskowitz et al. | |
| 5,695,286 | A | | 12/1997 | Williamson et al. | |
| 5,702,339 | A | | 12/1997 | Smiley | |
| 5,711,126 | A | | 1/1998 | Wells | |
| 5,711,796 | A | | 1/1998 | Grzybowski et al. | |
| 5,758,971 | A | * | 6/1998 | Goglio et al. | 383/10 |
| 5,772,751 | A | | 6/1998 | Nisnevich et al. | |
| 5,772,752 | A | | 6/1998 | Liskowitz et al. | |
| 5,772,937 | A | | 6/1998 | Cohen et al. | |
| 5,782,562 | A | | 7/1998 | Anspacher | |
| 5,830,815 | A | | 11/1998 | Wagh et al. | |
| 5,837,052 | A | | 11/1998 | Oates et al. | |
| 5,849,075 | A | | 12/1998 | Hopkins et al. | |
| 5,853,475 | A | | 12/1998 | Liskowitz et al. | |
| 5,897,704 | A | | 4/1999 | Baglin | |
| 5,935,885 | A | | 8/1999 | Hnat et al. | |
| 5,936,216 | A | | 8/1999 | Wu | |
| 5,965,201 | A | | 10/1999 | Jones, Jr. | |
| 5,974,762 | A | | 11/1999 | Rodgers | |
| 5,976,224 | A | | 11/1999 | Durant et al. | |

| | | | |
|---|---|---|---|
| 5,988,864 | A | 11/1999 | Bracegirdle |
| 5,992,336 | A | 11/1999 | Ramme |
| 6,021,611 | A | 2/2000 | Wells et al. |
| 6,030,446 | A | 2/2000 | Doty et al. |
| 6,038,987 | A | 3/2000 | Koshinski |
| 6,054,074 | A | 4/2000 | Wu et al. |
| 6,065,871 | A | 5/2000 | Warr et al. |
| 6,068,803 | A | 5/2000 | Weyand et al. |
| 6,079,175 | A | 6/2000 | Clear |
| 6,083,431 | A | 7/2000 | Ikari et al. |
| 6,105,335 | A | 8/2000 | Vohra |
| 6,112,492 | A | 9/2000 | Wells et al. |
| 6,145,343 | A | 11/2000 | Jantzen et al. |
| 6,149,555 | A | 11/2000 | Kinback |
| 6,168,709 | B1 | 1/2001 | Etter |
| 6,180,192 | B1 | 1/2001 | Smith et al. |
| 6,200,379 | B1 | 3/2001 | Strabala |
| 6,204,430 | B1 | 3/2001 | Baldwin et al. |
| 6,213,754 | B1 | 4/2001 | Doty et al. |
| 6,240,859 | B1 | 6/2001 | Jones, Jr. |
| 6,250,235 | B1 | 6/2001 | Oehr et al. |
| 6,258,994 | B1 | 7/2001 | Jantzen et al. |
| 6,269,952 | B1 | 8/2001 | Watt et al. |
| 6,277,189 | B1 | 8/2001 | Chugh |
| 6,309,570 | B1 | 10/2001 | Fellabaum |
| 6,319,482 | B1 | 11/2001 | Sawell et al. |
| 6,334,895 | B1 | 1/2002 | Bland |
| 6,402,379 | B1 | 6/2002 | Albright |
| 6,528,547 | B2 | 3/2003 | Schulman |
| 6,609,999 | B2 | 8/2003 | Albright |
| 6,886,980 | B1 | 5/2005 | Diplock |
| 6,935,781 | B2 * | 8/2005 | Makino et al. ..... 383/9 |
| 2002/0023408 | A1 * | 2/2002 | Bitowft et al. ..... 53/413 |
| 2002/0086790 | A1 | 7/2002 | Jensen et al. |
| 2003/0205035 | A1 * | 11/2003 | Bussey et al. ..... 53/576 |
| 2005/0053313 | A1 | 3/2005 | Lucas et al. |

FOREIGN PATENT DOCUMENTS

| | | | |
|---|---|---|---|
| DE | 157092 | A | 10/1982 |
| GB | 1 564 600 | | 4/1980 |
| GB | 2 069 456 | | 8/1981 |
| GB | 2 227 928 | A | 8/1990 |
| GB | 2 341 382 | A | 3/2000 |
| JP | 61021940 | | 1/1986 |
| JP | 01-023955 | A | 1/1989 |
| JP | 3226460 | | 7/1991 |
| JP | 3242156 | A | 10/1991 |
| JP | 2001261416 | | 9/2001 |
| WO | WO 8600290 | | 1/1986 |
| WO | WO 98/01404 | | 1/1998 |
| WO | WO 02/79044 | A | 5/2000 |

OTHER PUBLICATIONS

Morton Salt, Water Softening, http:\www.mortonsalt.com/consumer/products/watersoftening/system_saver.htm.
Cargill Salt, Diamond Crystal, http:/www.cargillsalt.com/cargillsalt/product.asp?catalog%5Fname=Salt+Product+Catalog &category%5Fname=Water+Condit....
Cargill Salt Advertising Brochure.

* cited by examiner

PACKAGING FOR PARTICULATE AND GRANULAR MATERIALS

CROSS-REFERENCE TO RELATED APPLICATIONS

This application claims benefit of U.S. Provisional Application No. 60/672,704, filed Apr. 19, 2005, and U.S. Provisional Application 60/574,860, filed May 27, 2004, which are hereby incorporated herein in their entirety by reference.

BACKGROUND OF THE INVENTION

1. Field of the Invention

The present invention relates generally to packaging and, more particularly, to packaging and methods for packaging for particulate and granular materials.

2. Description of Related Art

Particulate and granular materials are commonly packaged in bags, sacks or other packaging materials (collectively referred to herein as "bags") constructed of paper. As used herein, the term "particulate materials" refers to powdery materials that generate dust when disturbed, such as during packaging. For purposes of example only and not limitation, particulate materials can include cementitious materials, such as cement and concrete mixes, limestone, fly ash, bottom ash, powdered sugar, etc. As used herein, the term "granular materials" refers to materials that are composed of granules or grains, or have a grainy texture, and which may or may not generate dust when disturbed. For purposes of example only and not limitation, granular materials can include sand, pea gravel, sugar, salt, etc.

The conventional paper bags used to package particulate and granular materials are generally closed at one end either when the bag is made or prior to filling by folding the sides of the bag inwardly in an overlapping configuration and then securing the sides together using an adhesive. The bags are filled with the particulate or granular material through the open end of the bag, which is then closed by folding the sides of the bag inwardly in an overlapping configuration and then securing the sides together using an adhesive.

Conventional paper bags are structured to allow air to escape from the interior of the bags so that the bags can be compressed when the bags are stacked, such as on a pallet. However, conventional paper bags have several disadvantages. For example, in addition to allowing air to escape, conventional paper bags also can allow fine particles from the particulate or granular material inside the bag to escape, which can result in appreciable amounts of dust, particularly when storing the bags in an enclosed space such as a warehouse or inside a store. Conventional paper bags also are susceptible to rupturing or tearing if not handled properly, which can result in product spillage and waste. Conventional paper bags also allow moisture to permeate the bag, which will typically have an adverse effect on the particulate or granular material inside the bag. For example, where the bag is used to package cementitious material, moisture can lead to curing of the cementitious material inside the bag thereby rendering the product useless. This can be particularly problematic when storing or handling the bags outside where the bags can be exposed to rain, condensation or other wet ambient conditions. Conventional paper bags also can be difficult to load and unload manually when the bags are filled with particulate or granular material. For example, bags used to package cementitious material are typically offered in 29 lb, 44 lb, 50 lb, 60 lb and 80 lb bags, which are heavy and can be difficulty to carry.

Accordingly, there remains a need for packaging for particulate and granular material generally and cementitious materials in particular. The packaging should be capable of being filled and sealed using an automated filling machine and should allow the particulate or granular material to be stored so as to minimize leakage, spillage and exposure to moisture. The packaging should also be stackable when filled with particulate or granular material, such as on a pallet, and should also facilitate manual loading and unloading of the filled packaging.

SUMMARY OF THE INVENTION

The present invention provides package for particulate and granular material. According to one embodiment, the package includes a bag formed of a polymeric material. The bag has first and second ends. The first end of the bag is sealed and the second end of the bag is open. The first end of the bag has a first tab extending therefrom defining at least one aperture therethrough so that the first tab defines a first handle. In one embodiment, the edge of the at least one aperture in the first tab is at least partially sealed. The second end of the bag is structured to be sealed after filling the bag with the particulate or granular material. The second end of the bag has an excess portion structured to be formed into a second tab defining at least one aperture therethrough upon sealing of the second end of the bag so as to define a second handle. In one embodiment, the bag has first and second sides, wherein at least a portion of the first side and/or the second side of the bag defines a textured surface.

The present invention provides package for cementitious material. According to one embodiment, the package includes a bag formed of a polymeric material. The bag has first and second ends. The first end of the bag is sealed and the second end of the bag is open. The first end of the bag has a first tab extending therefrom defining at least one aperture therethrough so that the first tab defines a first handle. In one embodiment, the edge of the at least one aperture in the first tab is at least partially sealed. The second end of the bag is structured to be sealed after filling the bag with the cementitious material. The second end of the bag has an excess portion structured to be formed into a second tab defining at least one aperture therethrough upon sealing of the second end of the bag so as to define a second handle. In one embodiment, the bag has first and second sides, wherein at least a portion of the first side and/or the second side of the bag defines a textured surface.

The present invention also provides a packaged product containing particulate or granular material. According to one embodiment, the packaged product includes a bag formed of a polymeric material. The bag has first and second sealed ends. The first sealed end has a first tab extending therefrom defining at least one aperture therethrough so that the first tab defines a first handle. The second sealed end has a second tab extending therefrom defining at least one aperture therethrough so that the second tab defines a second handle. In one embodiment, the edge of the at least one aperture in the first tab and/or second tab is at least partially sealed. A particulate or granular material is sealed within the bag, wherein the first and second handles facilitate the handling of the packaged product. In one embodiment, the bag has first and second sides, wherein at least a portion of the first side and/or the second side of the bag defines a textured surface.

The present invention also provides a packaged cementitious product. According to one embodiment, the packaged cementitious product includes a bag formed of a polymeric material. The bag has first and second sealed ends. The first sealed end has a first tab extending therefrom defining at least one aperture therethrough so that the first tab defines a first handle. The second sealed end has a second tab extending therefrom defining at least one aperture therethrough so that the second tab defines a second handle. In one embodiment, the edge of the at least one aperture in the first tab and/or second tab is at least partially sealed. A cementitious product is sealed within the bag, wherein the first and second handles facilitate the handling of the packaged cementitious product. In one embodiment, the bag has first and second sides, wherein at least a portion of the first side and/or the second side of the bag defines a textured surface.

The present invention also provides a method for packaging particulate or granular material. According to one embodiment, the method includes providing a bag formed of a polymeric material, the bag having first and second ends. In one embodiment, the providing step includes forming the bag. The first end of the bag is sealed and the second end of the bag is open. The first end of the bag has a first tab extending therefrom defining at least one aperture therethrough so that the first tab defines a first handle. In one embodiment, the providing step includes heating a die and forming the at least one aperture through the first tab using the heated die. In one embodiment, the heating step comprises heating the die to between approximately 420° F. to approximately 460° F. The bag is filled with a predetermined amount of particulate or granular material. The second end of the bag is sealed so as to form a second tab extending therefrom. At least one aperture is formed through the second tab so that the second tab defines a second handle. In one embodiment, the forming step comprises heating a die and forming the at least one aperture through the second tab using the heated die. In one embodiment, the heating step comprises heating the die to between approximately 420° F. to approximately 460° F. In one embodiment, substantially all of the air is removed from the interior of the bag. In one embodiment, the removing step comprises compressing the bag. In another embodiment, the removing step comprises evacuating air from the bag prior to the sealing step. In another embodiment, the filling step and the evacuating step are done concurrently. In yet another embodiment, a plurality of bags are stacked on a pallet. In still another embodiment, the plurality of bags are secured to the pallet.

The present invention also provides a method for packaging cementitious material. According to one embodiment, the method includes providing a bag formed of a polymeric material, the bag having first and second ends. In one embodiment, the providing step includes forming the bag. The first end of the bag is sealed and the second end of the bag is open. The first end of the bag has a first tab extending therefrom defining at least one aperture therethrough so that the first tab defines a first handle. In one embodiment, the providing step includes heating a die and forming the at least one aperture through the first tab using the heated die. In one embodiment, the heating step comprises heating the die to between approximately 420° F. to approximately 460° F. The bag is filled with a predetermined amount of cementitious material. In one embodiment, the filling step includes filling the bag with approximately 29 lbs, 44 lbs, 50 lbs, 60 lbs or 80 lbs of cementitious material. The second end of the bag is sealed so as to form a second tab extending therefrom. At least one aperture is formed through the second tab so that the second tab defines a second handle. In one embodiment, the forming step comprises heating a die and forming the at least one aperture through the second tab using the heated die. In one embodiment, the heating step comprises heating the die to between approximately 420° F. to approximately 460° F. In one embodiment, substantially all of the air is removed from the interior of the bag. In one embodiment, the removing step comprises compressing the bag. In another embodiment, the removing step comprises evacuating air from the bag prior to the sealing step. In another embodiment, the filling step and the evacuating step are done concurrently. In yet another embodiment, a plurality of bags are stacked on a pallet. In still another embodiment, the plurality of bags are secured to the pallet.

The present invention also provides an apparatus for forming handles in polymeric packaging for particulate and granular material. The apparatus includes a die structured to form at least one aperture in the packaging. The apparatus also includes at least one heating element structured to heat the die such that the die seals the edges of the at least one aperture. In one embodiment, the die comprises a forming portion and a backing member. In another embodiment, the at least one heating element is structured to heat the die to between approximately 420° F. to approximately 460° F.

Accordingly, there has been provided packaging and associated packaging methods for particulate and granular material generally and cementitious materials in particular. The packaging is capable of being formed, filled and sealed using an automated forming, filling and sealing machine and allows the particulate or granular material to be stored so as to minimize leakage, spillage and exposure to moisture. The packaging is stackable when filled with the particulate or granular material, such as on a pallet, and also facilitates manual loading and unloading of the filled packaging.

BRIEF DESCRIPTION OF THE DRAWINGS

The foregoing and other advantages and features of the invention, and the manner in which the same are accomplished, will become more readily apparent upon consideration of the following detail description of the invention taken in conjunction with the accompanying drawings, which illustrate preferred and exemplary embodiments and which are not necessarily drawn to scale, wherein.

DETAILED DESCRIPTION OF THE INVENTION

The present invention now will be described more fully hereinafter with reference to the accompanying drawings, in which some, but not all embodiments of the invention are shown. This invention may be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
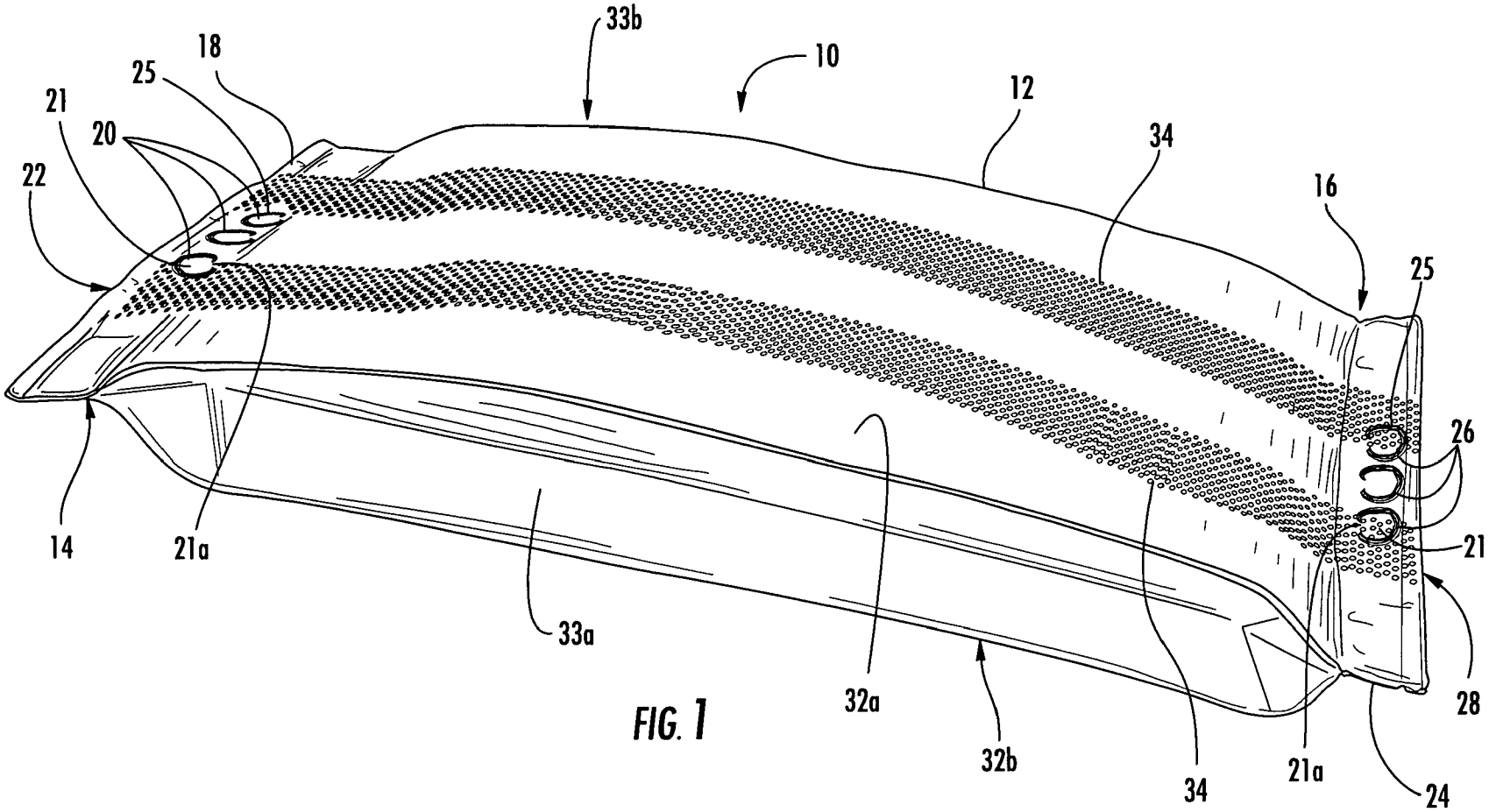
FIG. 1 is a perspective view illustrating a packaged product, according to one embodiment of the present invention.

Referring to FIG. 1, there is illustrated a packaged product 10 of particulate or granular material, according to one embodiment of the present invention. The packaged product 10 includes a bag 12 formed of a polymeric material. The type of polymeric material and thickness of the material can vary depending on the type and weight of the particulate or granular material to be packaged. According to one embodiment, packaged cementitious products 10 are typically distributed in 29 lb, 44 lb, 50 lb, 60 lb, 80 lb, and 90 lb sizes, although other sizes can be provided. The polymeric material can include, but is not limited to, a blend of linear low density polyethylene, which provides elasticity to the bag, and high density polyethylene, which provides puncture resistance, and metallocenes, which provides strength. For example, according to one embodiment the bag 12 is formed of a blend of high density polyethylene, linear low density polyethylene, and metallocenes having a thickness of approximately 3 mil to 6 mil and, preferably, approximately 4 mil to 5 mil, and more preferably, approximately 5 mil. In one embodiment, all or portions of the polymeric material of the bag 12 are substantially transparent. In other embodiments, all or portions of the polymeric material of the bag 12 are translucent or opaque. For example, all or portions of the polymeric material of the bag 12 can be colored based upon or to denote the strength or composition of the particulate or granular material inside the bag to provide visual differentiation between different products 10 so that purchasers can easily identify the different products. In other embodiments, one or more colors can be printed on the bag 12, such as by screen printing, as can information relating to the contents of the bag and/or the producer of the bag (such as trademarks, etc.)

As illustrated in FIG. 1, the bag 12 has a first sealed end 14 and a second sealed end 16. The first and second sealed ends 14, 16 can be formed using a variety of techniques, as is known in the art. For example, the first and second sealed ends 14, 16 can be formed by applying energy, such as heat or irradiation, to one or both sides of the bag 12 at the first and second ends so as to fuse the sides of the bag together. This energy can be applied using a manual or automated filling machine. For example, a relatively thin Teflon coated bar can be heated and pressed against one side of the bag to fuse the sides together. The first sealed end 14 has a first tab 18 extending therefrom defining at least one aperture 20 therethrough so that the first tab defines a first handle 22. Similarly, the second sealed end 16 has a second tab 24 extending therefrom defining at least one aperture 26 therethrough so that the second tab defines a second handle 28. While not required, as illustrated in FIG. 1, the ends of the first and second tabs 18, 24 can be fused at the distal edges of the tabs by applying energy, such as heat or irradiation, to the ends of the tabs to further strength the tabs.

As illustrated in FIGS. 8-13, which are provided for purposes of example only and not limitation, the number of apertures 20, 26 and configuration of the apertures of the first and second handles 22, 28 can vary depending on the strength and thickness of the polymeric material and the weight of the particulate or granular material to be packaged within the bag 12. The first and second tabs 18, 24 preferably will include a plurality of apertures 20, 26, as illustrated in the exemplary embodiments shown in FIGS. 8-11 and 13, or an elongate aperture, as illustrated in exemplary embodiment shown in FIG. 12, as this will facilitate handling the bags 12 manually since multiple fingers can be inserted into the corresponding apertures 20, 26. For polymeric materials having lower strengths, the number of apertures 20, 26 formed in the first and second tabs 18, 24 can be reduced so as not to compromise the strength of the corresponding tab 18, 24. Preferably, the apertures 20, 26 are configured so as to minimize sharp corners or notches along the edges 25 to thereby minimize potential stress concentrations along the edges of the apertures. For bags 12 packaging larger or heavy loads of material, the apertures 20, 26 can be located a predetermined distance from the sealed ends 14, 16 of the bag and the distal end of the corresponding tab 18, 24 to further strengthen the handles 22, 28. For example, according to one embodiment, the apertures 20, 26 can be located approximately 6 mm to 10 mm from the sealed ends 14, 16 of the bag and the distal end of the corresponding tab 18, 24.

In forming the apertures 20, 26, the excess material 21 within the apertures can be removed entirely or, as illustrated in FIG. 1, a small section of material 21*a* can remain after forming the apertures that connects the excess material to the corresponding first or second tabs 18, 24. According to the embodiment illustrated in FIG. 1, when the bag 12 is lifted or picked up, the person lifting the bag inserts their finger(s) into the corresponding apertures 20, 26 thereby pushing the excess material 21 through the aperture.

As discussed more fully below, the apertures 20, 26 in the first and second tabs 18, 24 can be formed using a heated die such that the edges 25 of the apertures are at least partially sealed. In one embodiment, the die can include a rim so that the seal at the edges 25 of the apertures 20, 26 extends beyond the edges a predetermined distance. It has been found that using a heated die to at least partially seal the edges 25 of the apertures 20, 26 strengthens the material around the apertures and increases the tear resistance of the material and, thus, strengthens the first and second handles 22, 28 of the bag 12. Advantageously, the first and second handles 22, 28 of the bag 12 of the present invention do not require any further reinforcement, such as the application of reinforcing tape, in order to support the material stored in the bag. In addition, apertures 20, 26 having sealed edges 25 have the further benefit of containing any material that may escape into the first or second tabs 18, 24 due to a ruptured or defective first or second sealed end 14, 16, respectively, thus further minimizing product spillage.

Figure 14:
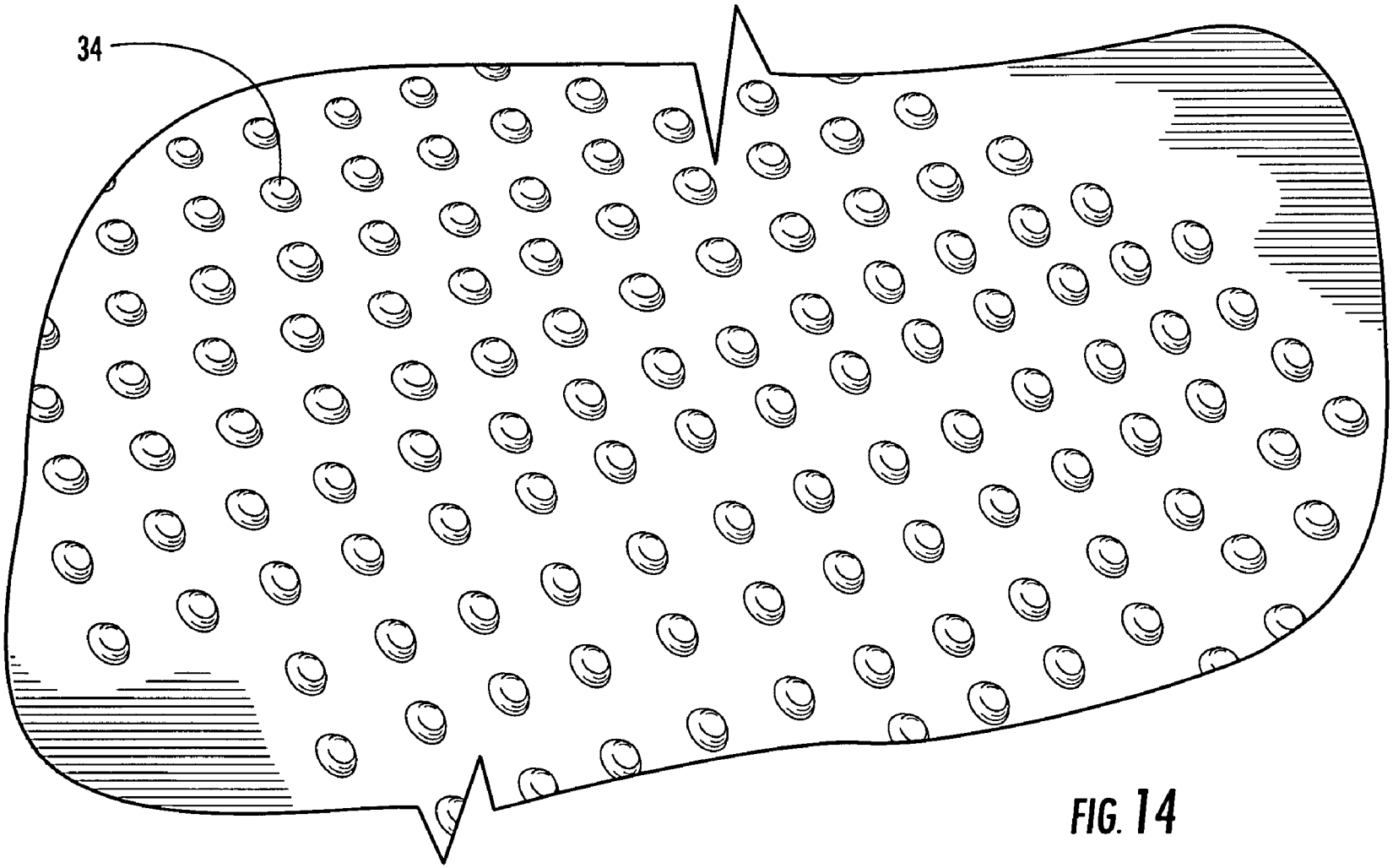
FIG. 14 is a partial perspective view illustrating the textured surface of one side of the package of FIG. 1, according to one embodiment of the present invention.
Figure 15:
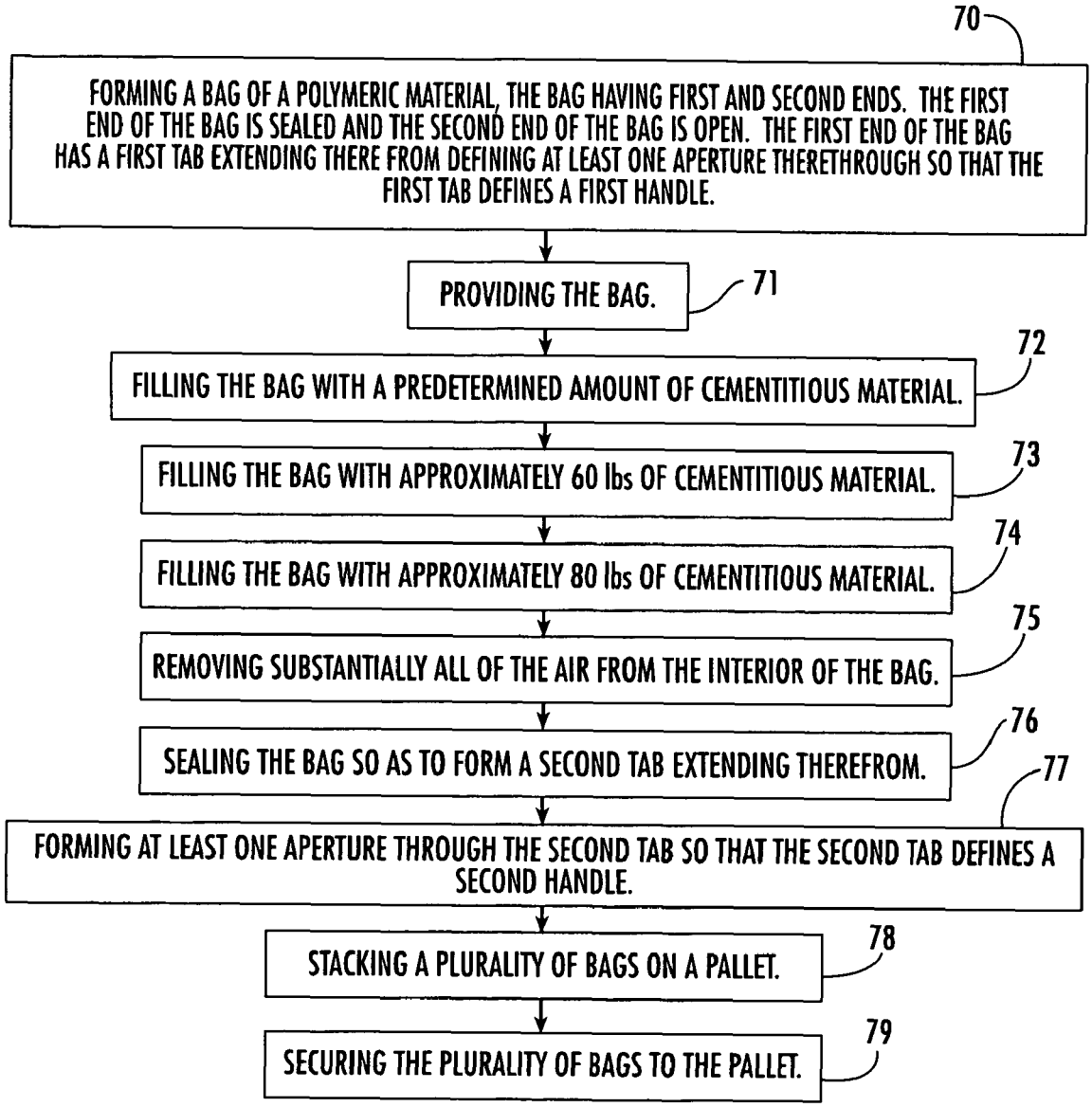
FIG. 15 is a block diagram illustrating a method for packaging a cementitious material, according to one embodiment of the present invention.

As illustrated in FIG. 1, the bag 12 includes first and second sides 32*a*, 32*b*. According to one embodiment of the present invention, as illustrated in FIGS. 1 and 14, at least a portion of at least one of the first and second sides 32*a*, 32*b* defines a textured surface 34, which creates friction between the corresponding bag 12 and an adjacent bag or surface. The friction created by the textured surface 34 prevents shifting of the bag during transport or storage thereby enabling the bags 12 to be stacked, such as on a pallet (not shown), for purposes of shipping the packaged product 10 in bulk. The types of textured surfaces 34, as well as the configuration and the number of areas of textured surface (for example, FIG. 1 illustrates two parallel areas of textured surface having a linear configuration) can vary provided sufficient friction is created between the corresponding bag 12 and an adjacent bag or surface to prevent shifting of the bag during transport or storage. As illustrated in FIG. 14, the textured surface 34 comprises a plurality of protuberances or raised members. In other embodiments (not shown), the textured surface 34 can comprise a plurality of recessed surfaces or dimples. Other types of textured surface 34 can be provided as well. In one embodiment, at least a portion of both the first and second sides 32*a*, 32*b* defines a textured surface 34.

Figure 2:
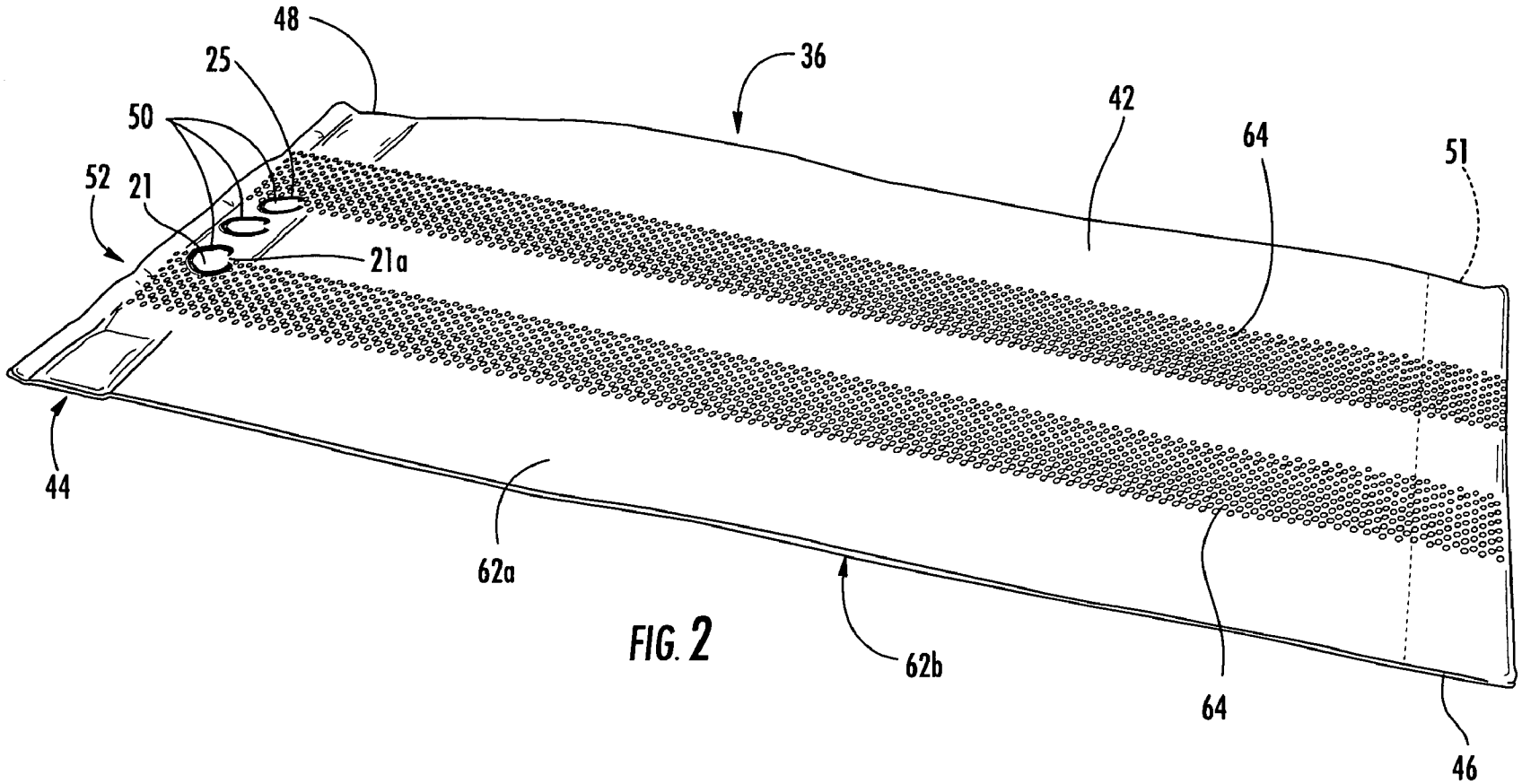
FIG. 2 is a perspective view illustrating a package for particulate and granular material, according to one embodiment of the present invention.

As illustrated in FIG. 2, the bag 12 can also include first and second gusseted sides 33*a*, 33*b*. Alternatively, the bag 12 can also be a non-gusseted bag. In one embodiment (not shown), the gusseted sides 33*a*, 33*b* can include perforations to allow air to escape from the bag 12, such as during filling of the bag with cementitious material, when using a bag flattener, and/or when stacking the bag for storage or shipping. The perforations can be formed using a variety of cutting techniques. In one embodiment, the perforations are formed using heated needles (also known as "microperfing") or a laser. In another embodiment (not shown), the gusseted bag 12 can include K seals at the corners of the first and second sealed ends 14, 16, as is known in the art, to provide the packaged product 10 with a generally rectangular or square configuration.

Referring to FIG. 2, there is illustrated a package 36 for particulate and granular materials, according to one embodiment of the present invention, that is used to form the product 10. The package 36 includes a bag 42 formed of a polymeric material, as discussed above. The bag 42 can be formed using a variety of techniques, such as mono-extrusion or co-extrusion. The bag 42 has a first sealed end 44 and a second end 46. The first sealed end 44 is formed as discussed above and includes a first tab 48 extending therefrom defining at least one aperture 50 therethrough so that the first tab defines a first handle 52. The second end 46 of the bag 42 is open so that the bag can be filled with the particulate or granular material. As discussed above, the first and second sides 62*a, b* of the bag 42 can be provided with a textured surface 64. In addition, the bag 42 can also include first and second gusseted sides 63*a*, 63*b*.

Figure 3:
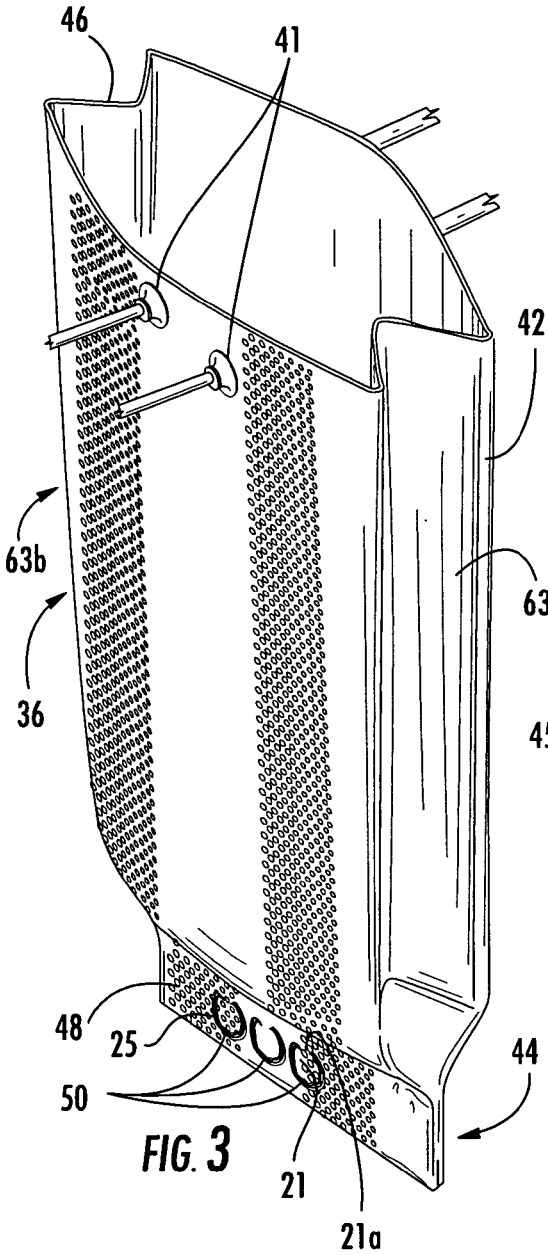
FIGS. 3 and 4 are perspective views illustrating the opening and filling of the package for particulate and granular material of FIG. 2, respectively, according to one embodiment of the present invention.
Figure 4:
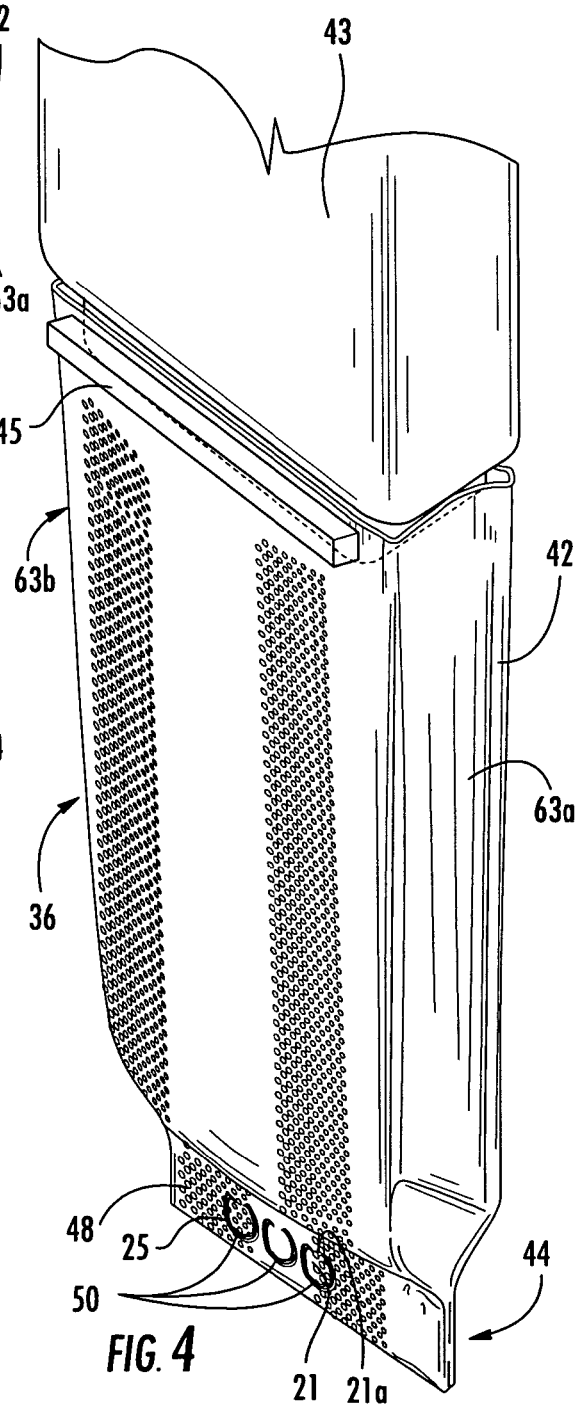
Figure 5:
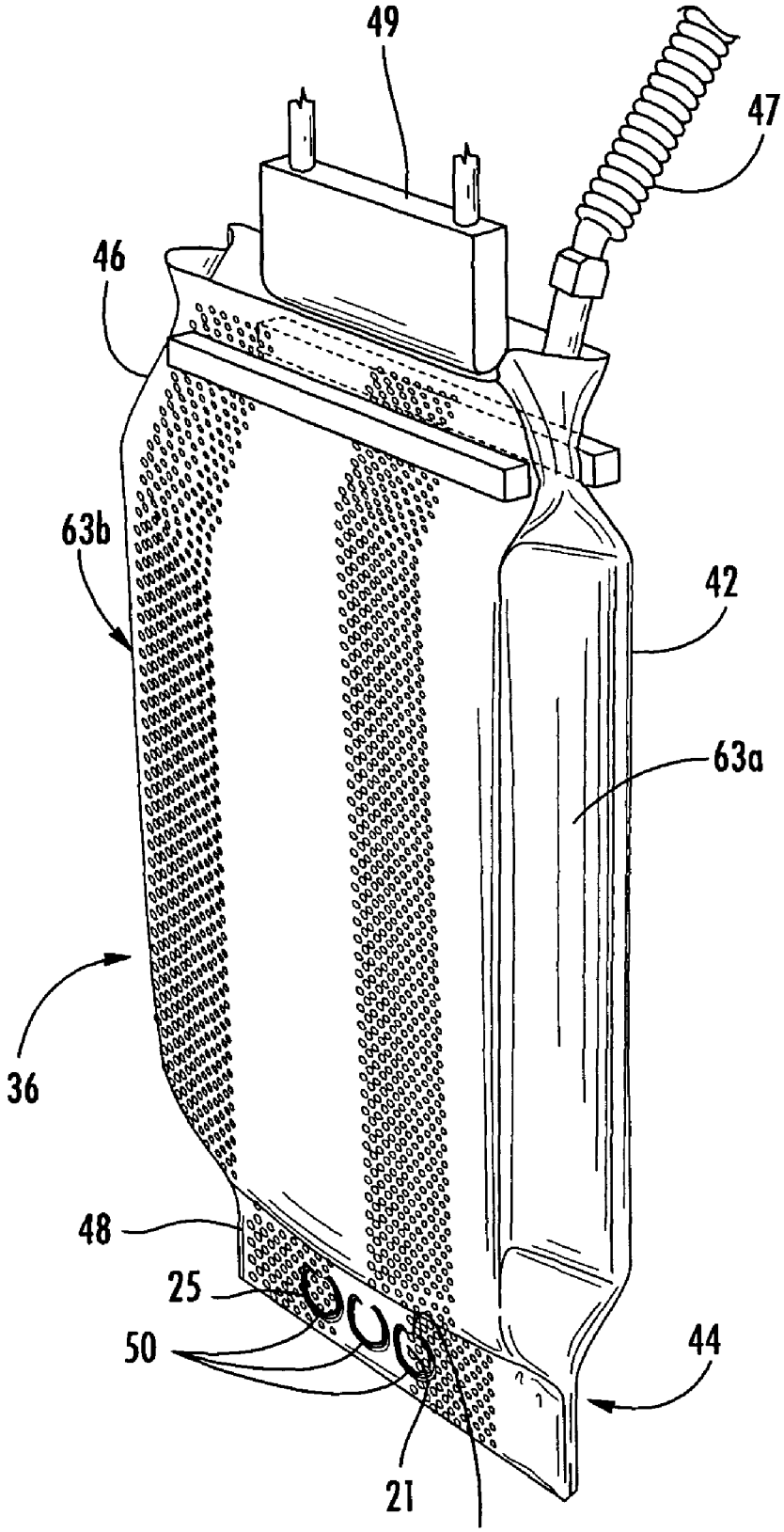
FIG. 5 is a perspective view illustrating the evacuation of air from the package for particulate and granular material of FIG. 4, according to one embodiment of the present invention.

According to one embodiment, the product 10 is formed from the package 36 in several steps, as illustrated in FIGS. 3-7. Referring to FIGS. 3 and 4, the bag 42 is filled with a predetermined amount or weight of particulate or granular material 60. FIG. 3 illustrates the second end 46 of the bag 42 being opened using suction cups 41. FIG. 4 illustrates the bag 42 being filled with a chute 43 as the edges of the edges of the second end 46 of the bag are secured against the chute with clamps 45. In one embodiment, as illustrated in FIG. 5, once the bag 42 is filled with material 60 the air inside the bag can be substantially removed by evacuating the bag using a vacuum or other suction device 47 so as to compress the bag around the material inside the bag. Alternatively, in another embodiment (not shown), the air inside the bag 42 can be substantially removed using a bag flattener after the packaged product 10 is formed. In one embodiment, as illustrated in FIG. 5, the inside edges of the second end 46 of the bag 42 preferably are cleaned prior to forming the second handle 58 using air and/or a cleaning device 49, which moves from side to side to dislodge any particles located on the inside edges. FIGS. 3-5 are provided for purposes of illustration only and not limitation, as the machinery or process used to fill the bag 42, clean the inside edges of the second end 46 of the bag 42, or evacuate air from inside the bag can vary depending on the type of particulate or granular material, the weight of the product 10 being made, the dimensions of the bag, etc.

Figure 6:
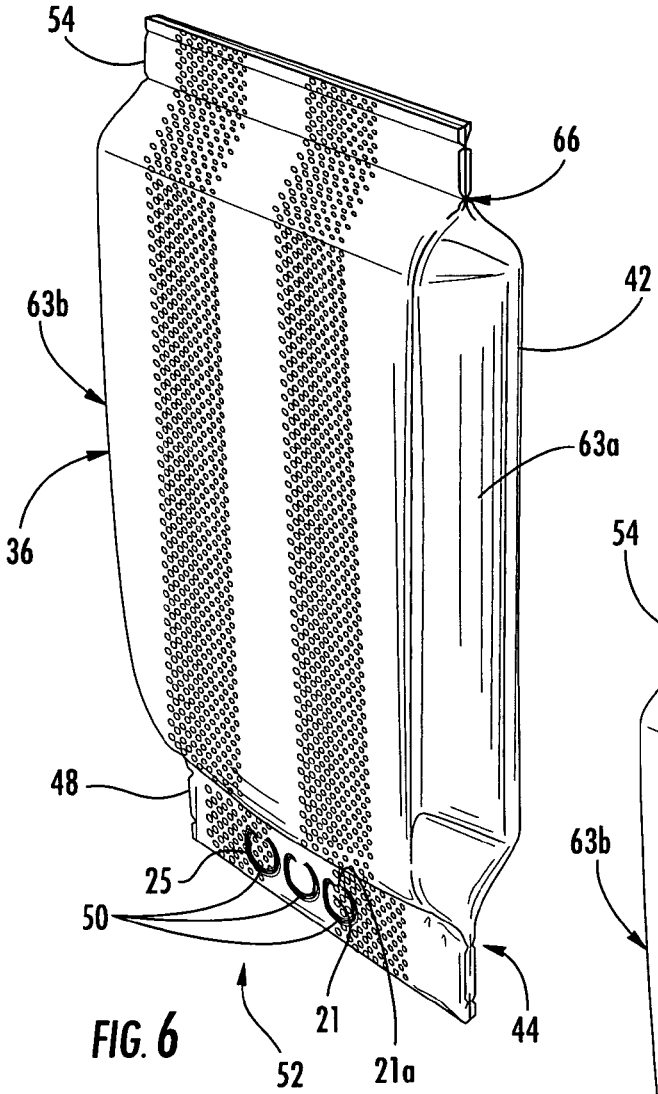
FIG. 6 is a perspective view illustrating the filled package of particulate and granular material of FIG. 5 after sealing the second end, according to one embodiment of the present invention.
Figure 7:
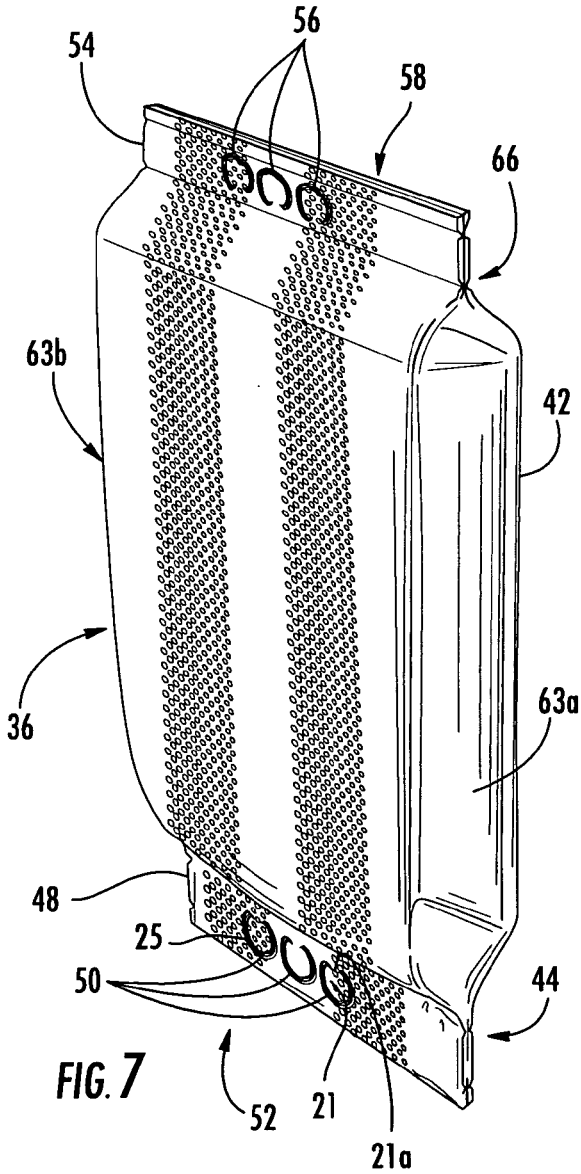
FIG. 7 is a perspective view illustrating the apertures formed in the tab extending from the second end of the filled package of FIG. 6, according to one embodiment of the present invention.
Figure 8:
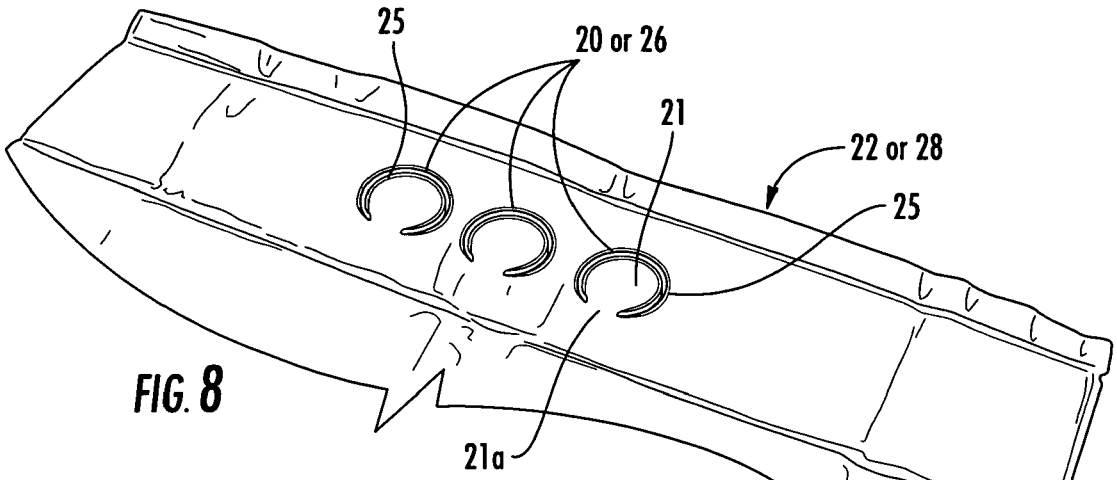
FIGS. 8-13 are partial perspective views illustrating various configurations of the first and/or second handle, according to embodiments of the present invention.
Figure 9:
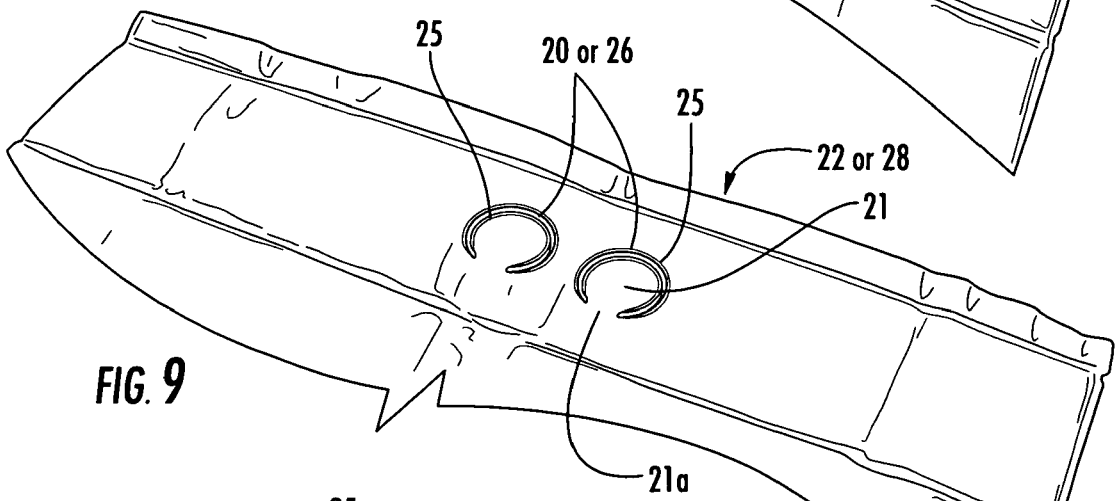
Figure 10:
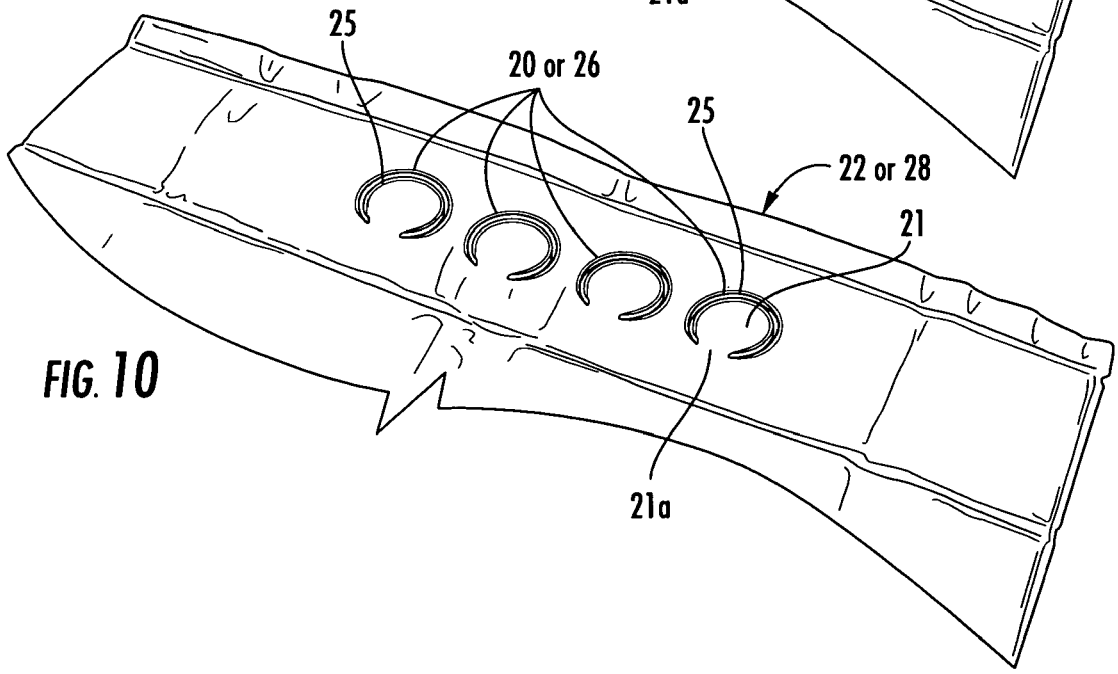
Figure 11:
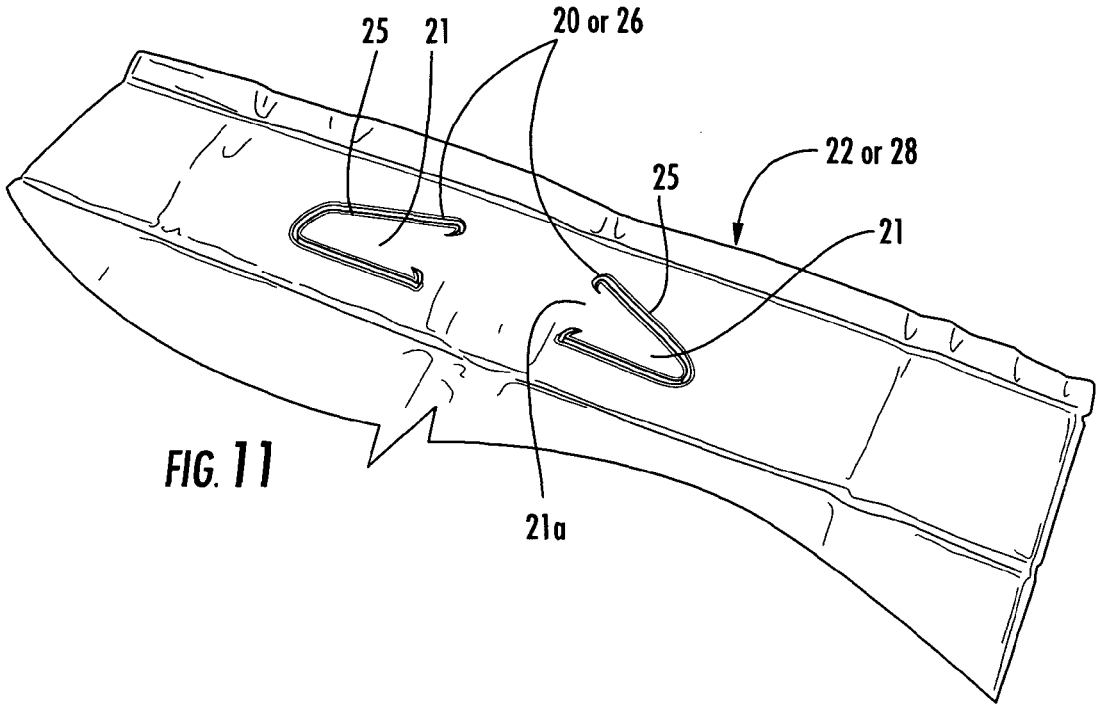
Figure 12:
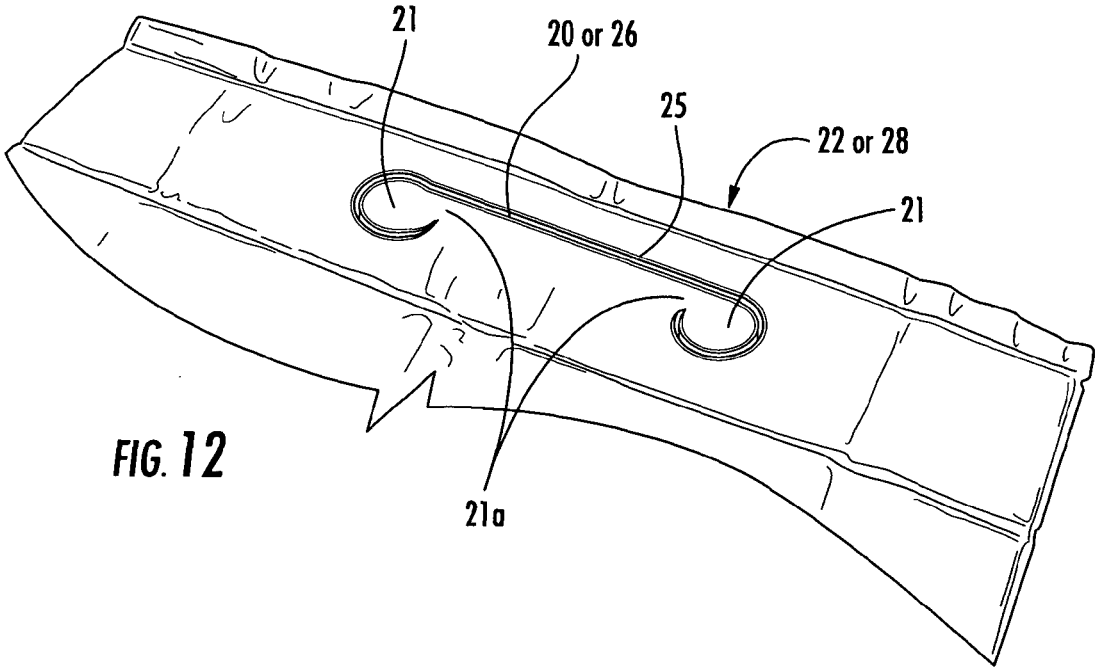

As illustrated in FIG. 6 and as discussed above, once the inside edges of the second end 46 of the bag 42 are cleaned, the second end 46 of the bag is sealed to thereby form a second sealed end 66 and a second tab 54. In this regard, and as illustrated in FIG. 2, the second end 46 of the bag 42 has an excess portion 51 structured to be formed into the second tab 54. While not required, as illustrated in FIG. 6, the first and second tabs 48, 54 can also be sealed at the distal edges of the tabs, as discussed above, to form a double seal to further strengthen the tabs. As illustrated in FIG. 7, at least one aperture 56 can be formed in the second tab 54 (such as by cutting or die stamping the second tab) so as to define a second handle 58.

According to another embodiment of the present invention (not shown), the evacuation of the air from the bag 42 can occur concurrently with the step of filling the bag with the material 60. For example, one or more probes can be inserted into the interior of the bag 42 and can evacuate the air from the bag as the bag is filled with material 60. Thereafter, the second end 46 of the bag 42 can be sealed, as discussed above.

In one embodiment, the package 36 is preformed. In another embodiment, the package 36 is formed from a roll of tubular film material (not shown). According to this embodiment, the first end of the bag is sealed to thereby form a first sealed end 44 and a first tab 48. At least one aperture 50 can be formed in the first tab 48 (such as by cutting or die stamping the second tab) so as to define a first handle 52. In one embodiment, the apertures 50 are formed in the first tab 48 and then the first end of the bag is sealed to form the first sealed end 44. The package 36 can be cut from the roll of tubular film material prior to, concurrently with, or after forming the first sealed end 44.

Figure 16:
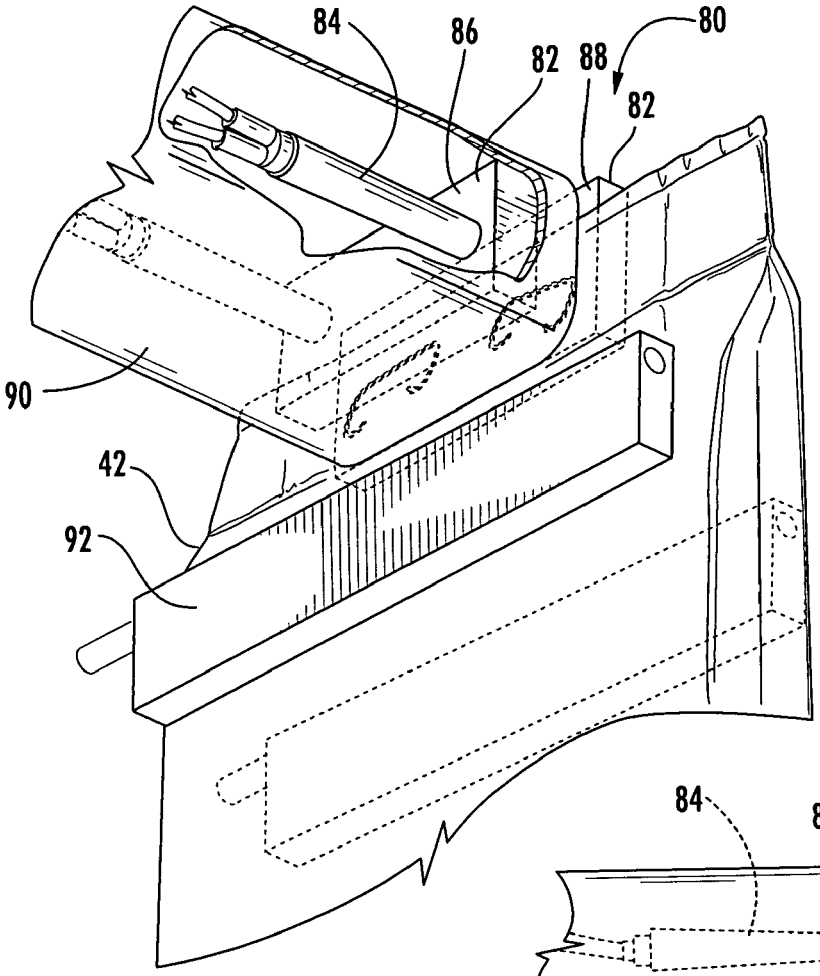
FIGS. 16 and 17 are partial perspective views illustrating the formation of the first and/or second handle, according to one embodiment of the present invention.
Figure 17:
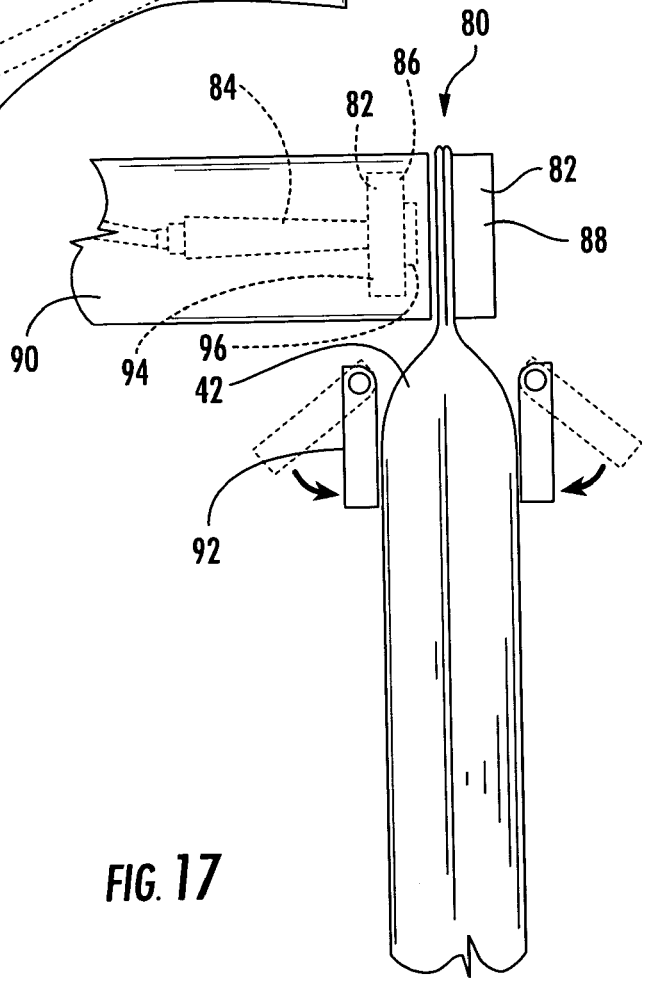
Figure 18A:
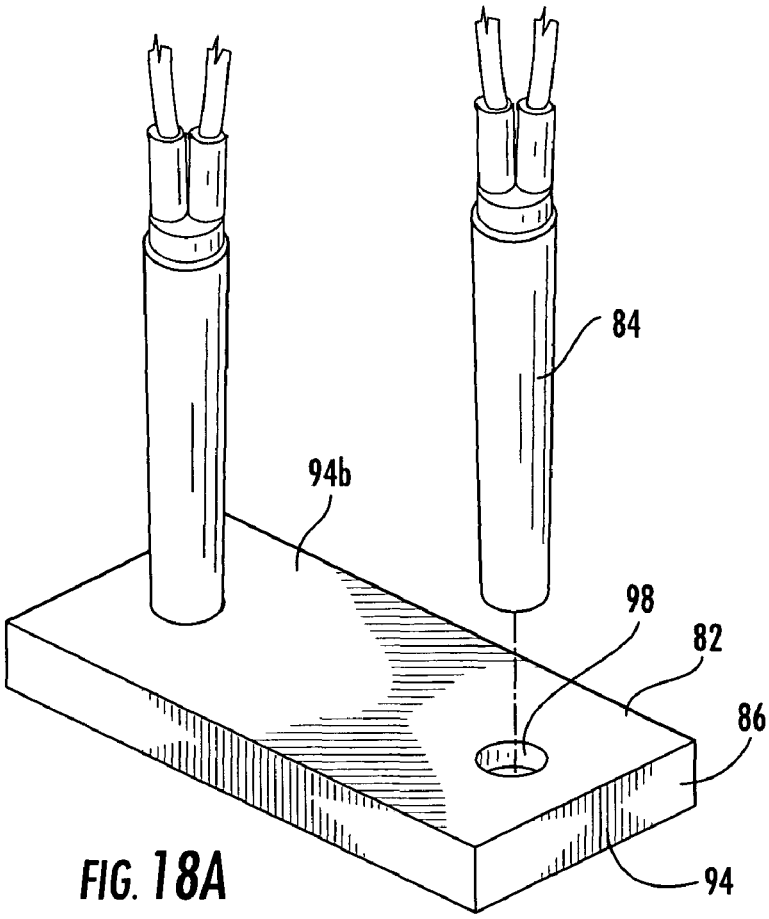
FIGS. 18A and 18B are partial perspective views illustrating a heated die used to form the first and/or second handle, according to one embodiment of the present invention.
Figure 18B:
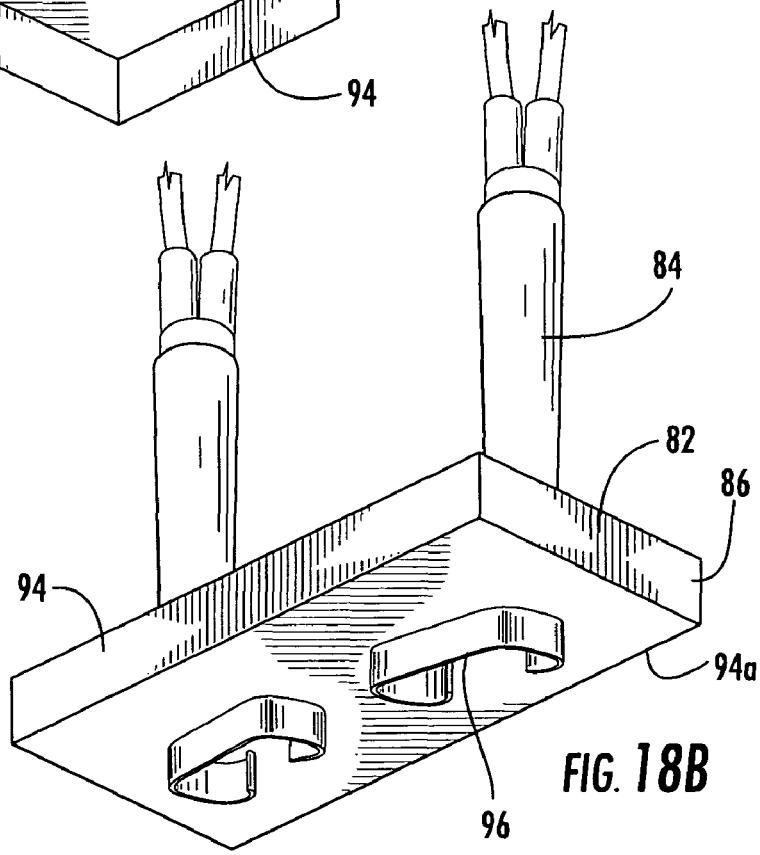

Referring to FIGS. 16-17, there is illustrated an apparatus 80 used to form the apertures 50, 56 in the first and second tabs 48, 54, respectively, according to one embodiment of the present invention. The apparatus 80 includes a die 82 and at least one heating element 84. The die 82 can include a forming portion 86 (as illustrated in FIGS. 18A and 18B) and a backing member 88. As illustrated in FIGS. 16 and 17, the apparatus 80 can include a housing 90 structured to receive the forming portion 86 of the die 82. In one embodiment, a hydraulic or pneumatic cylinder (not shown) seated within the housing 90 is used to move the forming portion 86 of the die 82 toward the backing member 88 when forming the apertures 50, 56 in the first and second tabs 48, 54. As illustrated in FIG. 17, the apparatus 80 can include a pair of clamps 92 to secure the bag 42 when forming the apertures 50, 56 in the first and second tabs 48, 54.

Referring to FIGS. 18A and 18B, the forming portion 86 of the die 82 can include a plate or block 94 having a first side 94*a* and a second side 94*b*. The first side 94*a* includes a raised portion 96 configured to form the apertures 50, 56 in the first and second tabs 48, 54 thereby forming the first and second handles 22, 28. In one embodiment, the second side 94*b* defines one or more apertures 98 structured to receive a corresponding heating element 84. The heating element or elements 84 can comprise an electrical resistance heater, such as the FIREROD® brand of heaters distributed by Watlow Electric Manufacturing Company of St. Louis, Mo. In other embodiments, other types of heating elements 84 can be used, including induction coils, convection heaters, lasers, etc. In one embodiment, the heating element 84 is structured to heat the forming portion 86 of the die 82 to between approximately 420° F. to approximately 460° F.

Figure 18C:
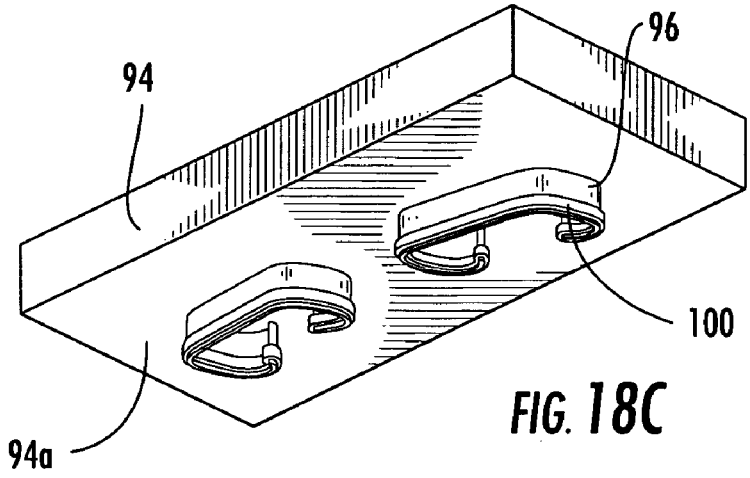
FIGS. 18C, 18D, and 18E are perspective, plan and side views, respectively, illustrating a rim on the raised portion of the forming portion of the die, according to one embodiment of the present invention.
Figure 18D:
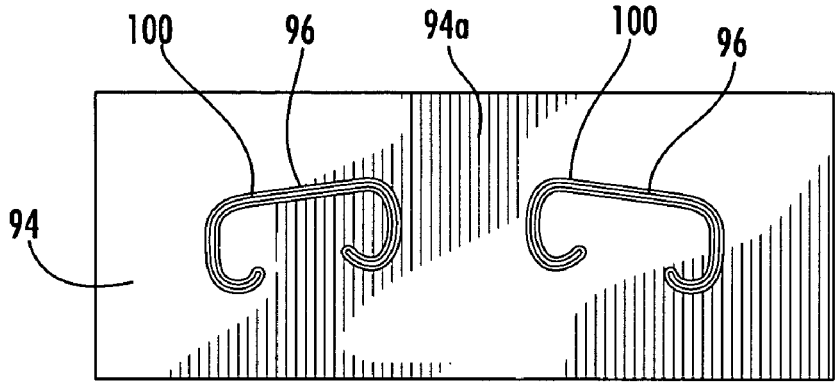
Figure 18E:
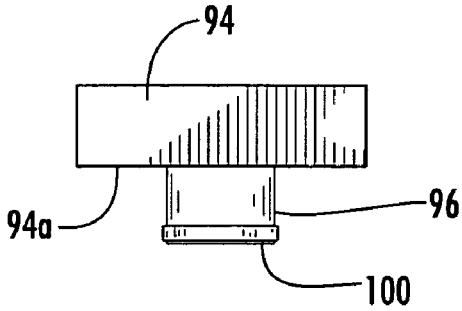

Referring to FIGS. 18C, 18D, and 18E, in one embodiment the raised portion 96 includes a rim 100 along the circumference of at least a portion of the distal end of the raised portion. The rim 100 can be around the entire circumference of the raised portion 96, but preferably is present around at least a portion of the circumference of the raised portion that faces away from the excess material 21. The rim 100 is structured to increase the heated surface area that contacts the first and second tabs 48, 54 to thereby enlarge the seal formed about the edges of the apertures 50, 56 in the first and second tabs so as to improve the tear resistance of the apertures.

The heated die 82 can be used to form the first and second handles 22, 28 of the bag 12 of the present invention or, in another embodiment (not shown), the heated die 82 can also be used to form packaging having a single handle by forming one or more apertures in a tab, as discussed above. It has been determined that using a heated die 82 to at least partially seal the edges of the apertures forming the handles strengthens the material around the apertures and increases the tear resistance of the material and, thus, provides a more robust handle. Advantageously, handles formed using the heated die 82 of the present invention do not require any further reinforcement, such as the application of reinforcing tape, in order to support the material stored in the bag 12. In addition, handle apertures having sealed edges have the further benefit of containing any material that may escape into the corresponding tab due to a ruptured or defective sealed end, respectively, thus further minimizing product spillage.

Figure 13:
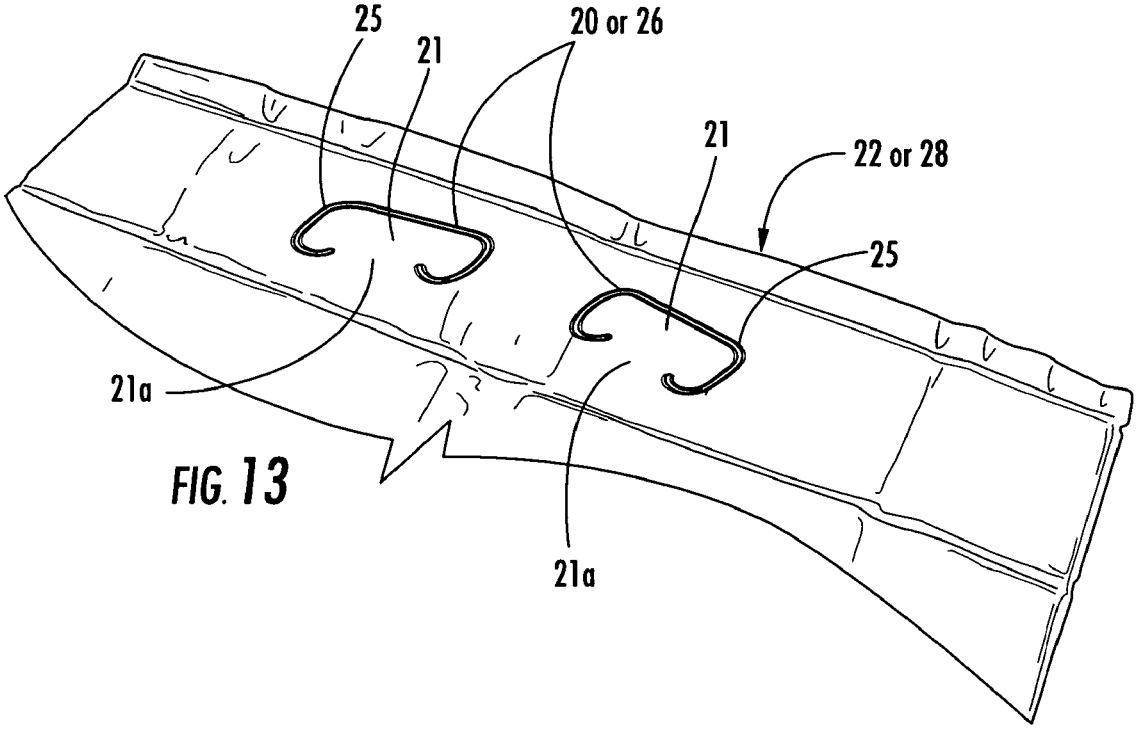

The present invention also provides a method of packaging particulate and granular material generally and cementitious materials in particular. According to one embodiment, as illustrated in FIG. 13, the method includes providing a bag formed of a polymeric material, the bag having first and second ends. See Block 71. The first end of the bag is sealed and the second end of the bag is open. The first end of the bag has a first tab extending therefrom defining at least one aperture therethrough so that the first tab defines a first handle. In one embodiment, the providing step includes forming the bag. See Block 70. The bag is filled with a predetermined amount of cementitious material. See Block 72. In one embodiment, the filling step includes filling the bag with approximately 60 lbs of cementitious material. See Block 73. In another embodiment, the filling step includes filling the bag with approximately 80 lbs of cementitious material. See Block 74. Substantially all of the air can be removed from the interior of the bag. See Block 75. The second end of the bag is sealed so as to form a second tab extending therefrom. See Block 76. At least one aperture is formed through the second tab so that the second tab defines a second handle. See Block 77. In one embodiment, a plurality of bags are stacked on a pallet. See Block 78. In another embodiment, the plurality of bags are secured to the pallet. See Block 79.

Figure 19:
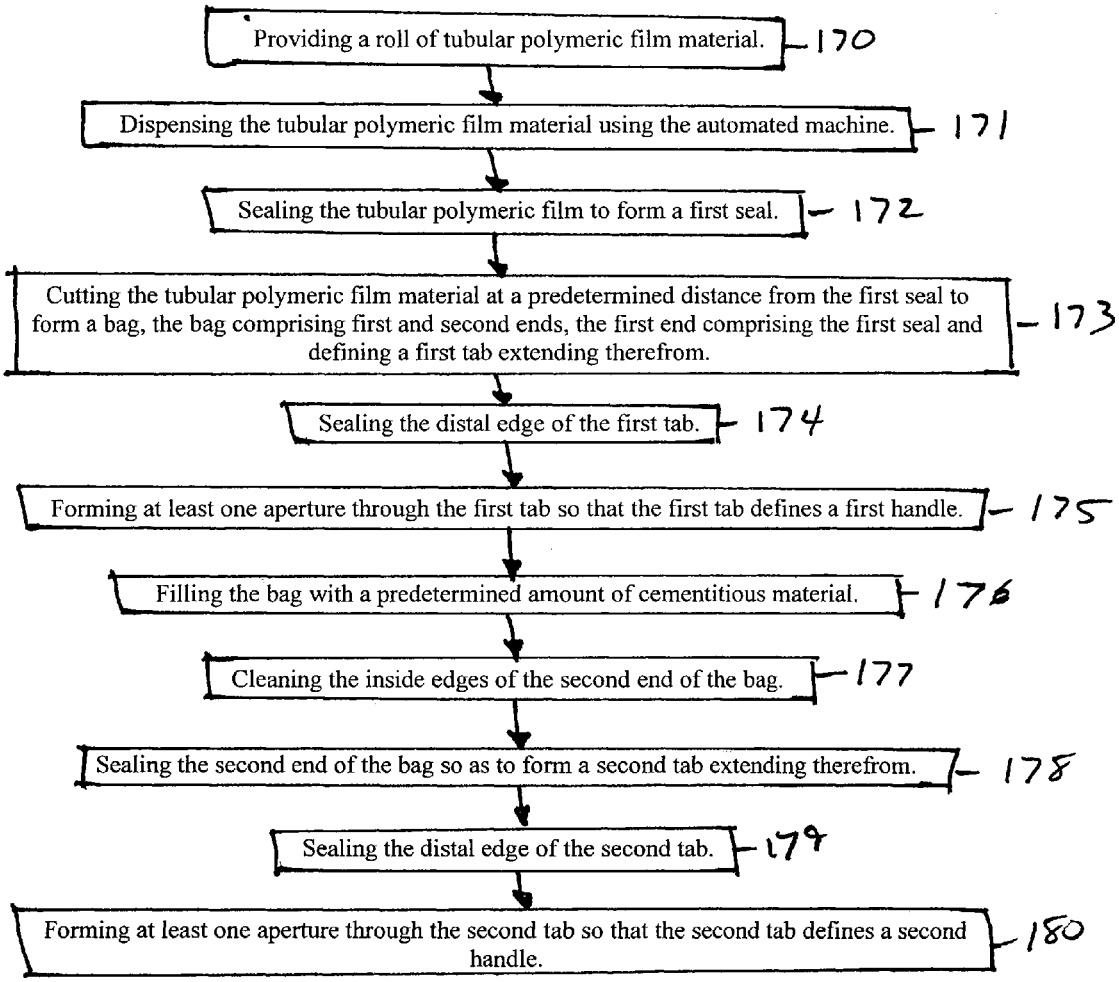
FIG. 19 is a block diagram illustrating a method for packaging a cementitious material, according to one embodiment of the present invention.

According to another embodiment, as illustrated in FIG. 19, the method includes providing a roll of tubular polymeric film material. See Block 170. The tubular polymeric film material is dispensed using the automated machine. See Block 171. The tubular polymeric film is sealed to form a first seal. See Block 172. The tubular polymeric film material is cut at a predetermined distance from the first seal to form a bag, the bag comprising first and second ends, the first end comprising the first seal and defining a first tab extending therefrom. See Block 173. The distal edge of the first tab is sealed. See Block 174. At least one aperture is formed through the first tab so that the first tab defines a first handle. See Block 175. The bag is filled with a predetermined amount of cementitious material. See Block 176. The inside edges of the second end of the bag are cleaned. See Block 177. The second end of the bag is sealed so as to form a second tab extending therefrom. See Block 178. The distal edge of the second tab is sealed. See Block 179. At least one aperture is formed through the second tab so that the second tab defines a second handle. See Block 180.

Advantageously, the packaging of the present invention is capable of being filled and sealed using an automated filling machine. This feature is particularly important in connection with particulate materials (such as cementitious materials), which are notoriously difficult to package using automated packaging machinery since the dust can inhibit the machinery from forming a proper seal. The packaging also allows the particulate or granular material to be stored so as to minimize leakage, spillage and exposure to moisture. The packaging is stackable when filled with particulate or granular material, such as on a pallet, and also facilitates manual loading and unloading of the filled packaging. Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method for packaging cementitious material using an automated machine, the method comprising:

providing a roll of tubular polymeric film material;

dispensing the tubular polymeric film material using the automated machine;

sealing the tubular polymeric film to form a first seal;

cutting the tubular polymeric film material at a predetermined distance from the first seal to form a bag, the bag comprising first and second ends, the first end comprising the first seal and defining a first tab extending therefrom;

sealing the distal edge of the first tab;

forming at least one aperture through the first tab so that the first tab defines a first handle;

filling the bag with a predetermined amount of cementitious material;

cleaning the inside edges of the second end of the bag;

sealing the second end of the bag so as to form a second tab extending therefrom;

sealing the distal edge of the second tab;

forming at least one aperture through the second tab so that the second tab defines a second handle; and wherein, the at least one aperture in the first tab and the at least one aperture in the second tab are at least partially sealed so that the first and second handles together are capable of supporting at least approximately twenty-nine (29) pounds of weight without any further reinforcement.

2. A method for packaging cementitious material according to claim 1 wherein said first forming step comprises heating a die and forming the at least one aperture through the first tab using the heated die.

3. A method for packaging cementitious material according to claim 2 wherein said heating step comprises heating the die to between approximately 420° F. to approximately 460° F.

4. A method for packaging cementitious material according to claim 1 wherein the bag has first and second sides, at least a portion of at least one of the first and second sides defines a textured surface.

5. A method for packaging cementitious material according to claim 1 wherein said polymeric material comprises a blend of high density polyethylene and linear low density polyethylene.

6. A method for packaging cementitious material according to claim 1 wherein said polymeric material has a thickness of about 4 to 6 mil.

7. A method for packaging cementitious material according to claim 1 wherein said first tab defines a plurality of apertures therethrough.

8. A method for packaging cementitious material according to claim 1 wherein said second forming step comprises forming a plurality of apertures through the second tab.

9. A method for packaging cementitious material according to claim 1 wherein said second forming step comprises heating a die and forming the at least one aperture through the second tab using the heated die.

10. A method for packaging cementitious material according to claim 9 wherein said heating step comprises heating the die to between approximately 420° F. to approximately 460° F.

11. A method for packaging cementitious material according to claim 1 wherein said filling step comprises filling the bag with one of approximately 29 lbs, 44 lbs, 50 lbs, 60 lbs, or 80 lbs of cementitious material.

12. A method for packaging cementitious material according to claim 1 further comprising removing substantially all of the air from the interior of the bag.

13. A method for packaging cementitious material according to claim 12 wherein said removing step comprises compressing the bag subsequent to said forming step.

14. A method for packaging cementitious material according to claim 12 wherein said removing step comprises evacuating air from the bag prior to said sealing step.

15. A method for packaging cementitious material according to claim 14 wherein said filling step and said evacuating step are done concurrently.

16. A method for packaging cementitious material according to claim 1 further comprising stacking a plurality of the bags on a pallet.

17. A method for packaging cementitious material according to claim 16 further comprising securing the stacked bags to the pallet.

* * * * *